United States Patent [19]

Craig

[11] 3,974,413

[45] Aug. 10, 1976

[54] INCANDESCENT LAMP WITH MODIFIED HELIUM FILL GAS

[75] Inventor: Gale M. Craig, Anderson, Ind.

[73] Assignee: General Motors Corporation, Detroit, Mich.

[22] Filed: May 1, 1975

[21] Appl. No.: 573,523

[52] U.S. Cl. ..... 313/222; 313/223; 313/226

[51] Int. Cl.[2] ..... H01K 1/50

[58] Field of Search ..... 313/222, 223, 226

[56] References Cited

UNITED STATES PATENTS 2,219,890 10/1940 Freitag et al. ..... 313/222 X

*Primary Examiner*—R. V. Rolinec
*Assistant Examiner*—Darwin R. Hostetter
*Attorney, Agent, or Firm*—J. C. Evans

[57] ABSTRACT

An incandescent lamp has an envelope defining a sealed fill gas cavity in which is located an electrically energizable tungsten filament that, when energized, has a sheath formed therearound of nonreactive gas and vaporized tungsten to suppress filament evaporation; the gas fill further includes a small quantity of helium in the range of 1% – 6% of the total gas charge effective to increase the density of the sheath and to increase temperature gradient within the sheath thereby to produce a drive force that improves the redeposition of tungsten vapor from the sheath back to the filament thereby to increase bulb life.

2 Claims, 2 Drawing Figures

INCANDESCENT LAMP WITH MODIFIED HELIUM FILL GAS

This invention relates to incandescent lamps and more particularly to a gas fill to improve the life characteristics of an incandescent lamp by reducing the evaporation of filament metal during lamp energization.

It is recognized that the use of nonreactive or inert gases such as argon, nitrogen, neon and krypton reduces the rate of evaporation of metal from a filament in an incandescent lamp. Heretofore, common practice has been to include heavier inert gases as the fill gas for an incandescent lamp on the basis that such heavier gases were more effective to suppress filament evaporation because they produced a more dense, protective gaseous sheath around the metallic filament. Additionally, it was observed that less heat loss occurs from a metallic filament in an energized incandescent lamp if heavier gases with lower thermal conductivities were used as the fill gas.

Additional factors that influence the density of a protective sheath formed around an energized filament in an incandescent lamp are pressure and temperature. It is recognized that higher fill pressures will increase lamp life nearly in direct proportion to pressure. This is attributable to reduced evaporation from the filament in the presence of increase fill gas pressures. Conversely, the effect of temperature on the life of an incandescent lamp, with a given fill pressure, has heretofore been based on a reduced gas density in the protective sheath. Increased temperatures cause increased tungsten vaporization with a resultant decrease in lamp life.

In the course of investigations on leak detection, I have discovered that a heretofore unreported modification of fill gas formulation can produce an unexpected variation in the temperature-density relationship of the protective sheath around an energized filament in an incandescent lamp so as to increase lamp life by 30% or more. The modification is in the form of a carefully selected small percentage of helium, preferably between 1% –]6% of a normal incandescent lamp bulb charge of normally selected, nonreactive heavy molecule gas such as one from the group including Argon, nitrogen, neon and krypton or a mixture thereof.

In present incandescent lamps, a phenomenon of thermal diffusion exists which is regarded as a detriment rather than a benefit in lamp operation. the term "thermal diffusion" as hereinafter used in the specification denotes the separation of gases of differing molecular weights upon having a thermal gradient applied thereacross. Heavier gases, when subjected to thermal diffusion, tend to migrate toward hotter regions while lighter gases migrate to cooler regions. In incandescent bulbs having a fill gas consisting of heavy molecule, nonreactive materials, the heaviest molecule or atom in the gas sheath around the energized filament are those of tungsten vapor. In such arrangements, the thermal diffusion process will move the heavier tungsten vapor molecules toward the hotter regions. This drives the tungsten vapor back to the filament where it condenses. This is a normally expected process and the rate of redeposition of tungsten vapor on the filament is related to the heat flux characteristics of the protective sheath around the filament hereinafter referred to as the well-known Langmuir sheath. The phenomenon of thermal diffusion can be explained further with reference to long incandescent lamps of the type partially filled with iodine. In such arrangements, a concentration of iodine around the tungsten filament reaches a level in such lamps so that they must be operated within a few degrees of perfectly horizontal to prevent the heavier iodine gas from flowing away from the higher end of the lamp thereby interrupting the halogen cycle in that end.

In U.S. Pat. No. 3,418,512 a light gas consisting of hydrogen is contained within an outer envelope to provide a buffering action to reduce filament leg attack. In such an arrangement, the upper limit for hydrogen inclusion is related to thermal conductivity of the mixture in the seal lamp enclosure. Inclusion of hydrogen in seal beam lamp constructions, however, can cause water cycle erosion. The problem of water cycle erosion is eliminated by the use of helium which is inert to production of such an effect.

An object of the present invention is to modify the fill gas in an incandescent lamp having a nonreactive inert gas fill, by the addition of a controlled percentage of helium that will reduce tungsten loss from an energized filament by increase of the temperature gradient within the Langmuir sheath.

Still another object of the present invention is to improve the life characteristics of incandescent bulbs having a nonreactive gas fill of heavy molecular gas and an electrically energizable metallic filament by modification of the fill gas formulation to employ the phenomenon of thermal diffusion in the lamp to increase Langmuir sheath density and to increase temperature gradients within a filament evaporation suppressing sheath around the filament and to do so by the inclusion of a controlled percentage of helium within the gas fill that is driven from the vicinity of the filament by thermal diffusion so as to produce a thermally conductive mixture around the sheath of a higher percentage of helium than in the sheath and wherein the gases of the sheath are thereafter cooled by loss of heat at a higher rate through the outer conductive mixture so as to produce a greater temperature gradient in the sheath to suppress metallic evaporation from the tungsten filament during energization thereof.

One working embodiment of the invention was in the form of a modified sealed beam headlamp having various mixtures of argon, nitrogen, helium and krypton as fill gases. Relative thermal loss from the sheath to the fill gases and ionic conduction voltage between an electrode and the filament were measured. The results indicate a high degree of exclusion of helium from the filament vicinity during filament energization. It is observed that a modified helium content between 1% – 6% produces optimum improvement in lamp life by virtue of the reduction of the rate of filament evaporation during incandescent bulb energization.

Further objects and advantages of the present invention will be apparent from the following description, reference being had to the accompanying drawings wherein a preferred embodiment of the present invention is clearly shown.

Figure 1:
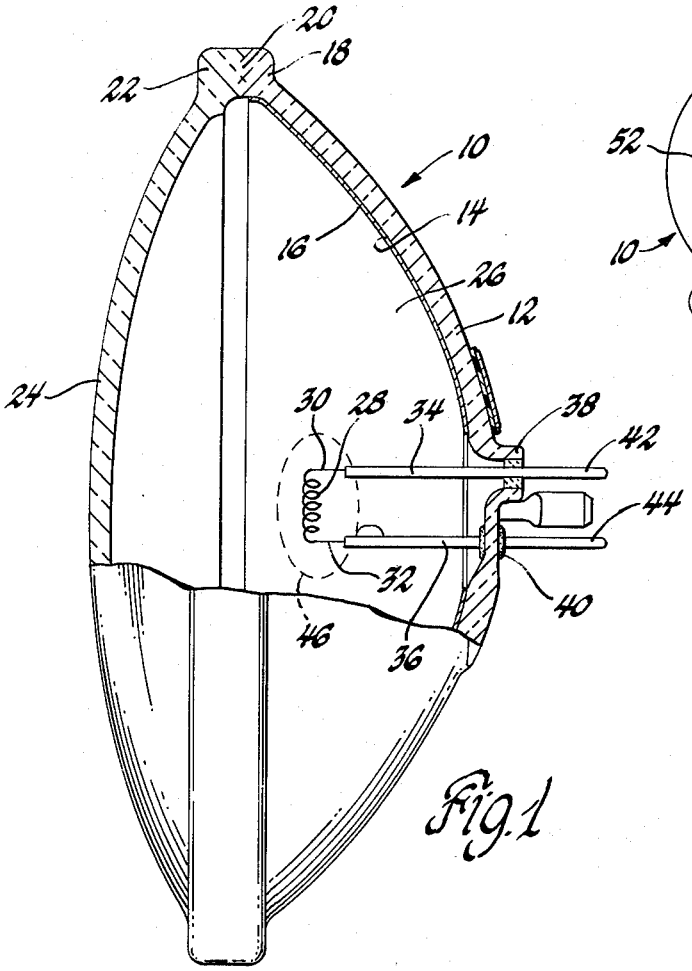
FIG. 1 is a view of a sealed beam incandescent head lamp partially in elevation and partially in vertical section having a gas fill modified in accordance with the present invention.

Referring now to the drawing, in FIG. 1, a modified sealed beam headlamp 10 is illustrated, which is representative of any incandescent lamp having an outer envelope and an electrically energized tungsten filament for directing light from within the envelope for illumination exteriorly thereof. In the illustrated arrangement, the envelope is defined by a concave reflector section 12 including a parabolically configured surface 14 thereon covered by a highly reflective coating 16. The reflector section 12 includes an outer peripheral flange 18 formed continuously therearound that is fused at a sealed joint 20 to an outer peripheral flange 22 of an optically clear lens 24 through which reflected light is directed from the coating 16 for illumination exteriorly of a sealed cavity 26. A filament 28 within the sealed cavity 26 has spaced apart legs 30, 32 connected to spaced apart lead wires 34, 36 that extend through electrically insulated seals 38, 40 connected respectively to terminals 42, 44 across which a power source is applied to electrically energize the filament 28. In the illustrated arrangement the filament 28 is a tungsten filament located approximately at the focal point of the parabolic surface 14, on which the reflective coat 16 is deposited.

The cavity 26 is filled with a modified inert gas charge which is one preferred embodiment consisting of 86% argon, 12% nitrogen and 2% helium and in another embodiment 98% argon and 2% helium. Still another gas charge consisted of krypton and argon constituting approximately 94% to 99% of the gas charge with helium constituting the remainder of the charge in the amounts of 6% to 1% of the volume, respectively.

Modification of a heavy molecular gas charge with 1% – 6% helium will cause the thermal conductivity of the gas fill in the cavity to increase throughout the lamp cavity. However, the increase of thermal conductivity is observed to be of a much lesser degree in the immediate vicinity of the filament 28. Since there is an increased temperature gradient in the vicinity of the filament 28, a "thermal diffusion" process will cause the heavier gas molecules and tungsten vapor produced in a Langmuir sheath 46 which surrounds the filament during energization thereof to migrate toward the hotter regions wthin the cavity 26 while the lighter molecules migrate to cooler regions. As a result, the Langmuir sheath surrounding the tungsten filament 28 has relatively little helium included therein. The gas mixture that is outside of the region 46 in surrounding relationship thereto thus has a greater resultant percentage of helium therein and will thereby have a greater thermal conductivity than the gas and vapor within the sheath 46.

As a result, the gas constituents within the sheath 46 will have a greater temperature gradient than would be the case if the gas charge within the cavity 26 were solely composed of nonreactive gas fill components made up of heavier gases in the family of argon, nitrogen, neon and krypton. Since the inclusion of helium in the gas fill mixture produces an increased temperature gradient across the sheath as compared to conventional fill gas mixtures, the resultant driving thermal diffusion effect on tungsten particles within the sheath 46 is greater than in previous designs. The greater temperature gradient within the sheath 46, as produced by the presence of helium in the range of 1% – 6%, will reduce the vaporization of tungsten from the filament 28. The gaseous heat loss from the filament 28 that is produced through the more thermally conductive mixture of helium and inert gas surrounding the sheath 46 will be increased over and above the heat loss found in gas fills without helium. This loss, however, represents only a small fraction of filament power and results in little or no reduction in the percentage of light output from the incandescent lamp represented by the seal beam unit in FIG. 1.

Figure 3:
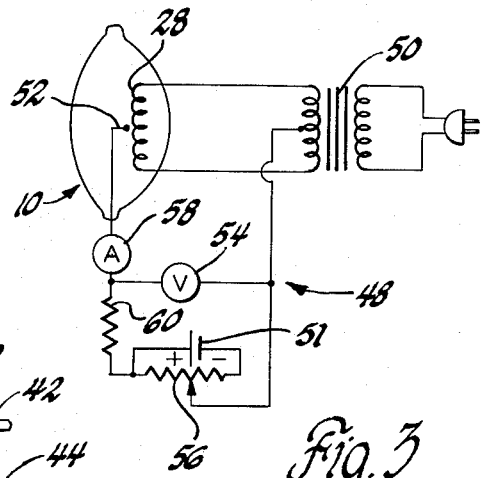
FIG. 3 is a diagrammatic view of an arc gap measurement system for determining the presence or absence of helium in a protective gas sheath in a filament of an incandescent lamp.

As illustrated in FIG. 3, tests have been made with seal beam units modified to have the gas fill set forth above. The various mixtures of argon, nitrogen, helium and krypton listed above were used as fill gases. A test system was developed as shown in FIG. 3. The sealed beam headlamp 10 is shown diagrammatically therein in association with a voltage measuring apparatus 48 including a transformer 50 for directing 12 volt energy across the filament 28. An electrode 52 is spaced from the filament by an arc gap in the order of 40 to 60 mils. A voltmeter 54 applid across the electrode and a center tap to the secondary of the transformer 50 is utilized to detect fill gas ionic conduction voltages. A potentiometer 56 in parallel with battery 51 is used to adjust the arc voltage. Relative arc voltages in the vicinity of the gap are measured and when ionization occurs it is observed by an ammeter 58. A resistor 60 protects against current surges at breakdown across the arc gap. Results indicate a high degree of exclusion of helium in the vicinity of the filament 28.

Figure 2:
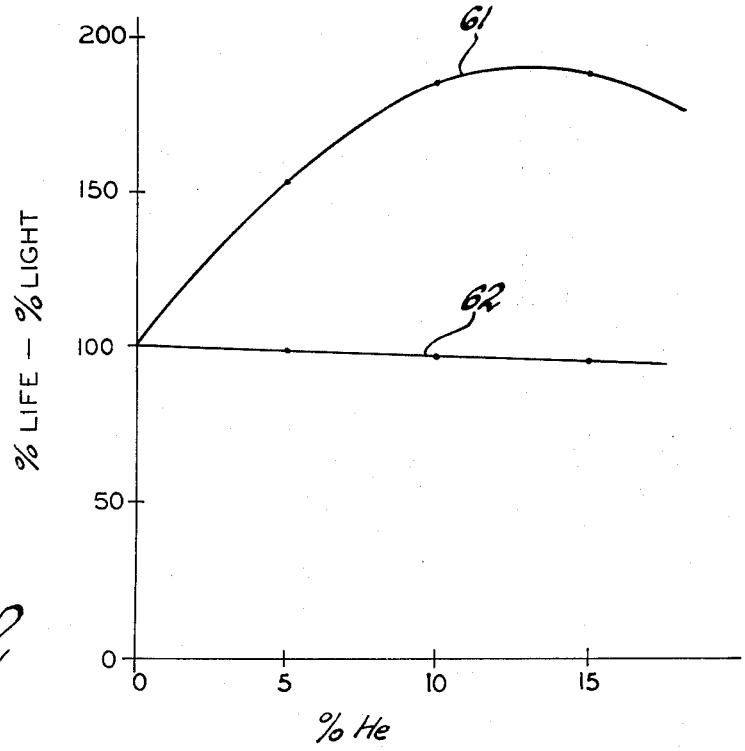
FIG. 2 is a graphic representation of the relationship between bulb life and percentage of helium and percentage of light as related to percentage of helium.

Test results indicate that the optimum fraction of helium in the fill gas will be in the range of 1% – 6% of the total gas fill. As illustrated in FIG. 2, percentages of helium in excess of approximately 10% result in a fall off of maximum increase in lamp life as illustrated by the change of slope on the curve 61 in FIG. 2. The curve 62 in FIG. 2 shows that the percentage light from the lamp also begins to decrease when the percentage of helium fraction exceeds approximately 7%. From the above, it can be observed that the increases in lamp life are related to some extent on luminous efficiency. However, an improvement in lamp life in the order of 30% might be reduced somewhat to increase luminous efficiency.

It is further surmised that the gas charge with a modified helium content in the range of 1% – 6% might be utilized in cases where a halogen gas such as monobromotrifluoromethane, $CBrF_3$, is present in the sealed enclosure to produce a tungsten halogen bulb with improved luminescense. In such arrangements, the helium reduces halogen attack on cooler tungsten parts within the sealed bulb. It proves quite beneficial in two filament headlamps by suppression of tungsten scavenging from the unlighted filament to the lighted filament.

Reduction of halogen attack in cooler regions by inclusion of helium might also make more practical the use of fill gases such as tetrafluoromethane, $CF_4$, which previously has proven to be unusable because of leg attack. In such arrangements, some gases, such as dichlorodifluoromethane, $CCl_2F_2$, has produced localized blackening and therefore has been eliminated as a possible gas. The use of a modified gas charge having 1% – 6% helium with the resultant increased thermal conductivity would be useful to produce more uniform wall temperatures, thus making a wider range of fill gas constituents possible for use in tungsten halogen lamps.

While the embodiments of the present invention, as herein disclosed, constitute a preferred form, it is to be understood that other forms might be adopted.

What is claimed is:

1. A sealed beam headlamp comprising: a reflector having a parabolic reflector surface, a lens having a peripheral surface sealed to said reflector to define a gas tight cavity, a tungsten filament, means supporting said filament within said cavity, means for electrically energizing said filament, a gas mixture in said cavity consisting of a nonreactive gas having a high molecular weight and a quantity of helium between 1% – 6% of the mixture, said helium constituent increasing thermal gradient near said filament when it is energized thereby to drive vaporized tungsten back toward said filament during energization of the filament.

2. An incandescent lamp comprising: gas tight envelope means, a tungsten filament, means for supporting said filament within said envelope including filament legs, an initial gaseous mixture within said envelope means consisting of a nonreactive gas having a high molecular weight and a quantity of helium in the range of from 1% – 6% of the mixture, means for electrically energizing said filament, a Langmuir sheath produced of gaseous mixture and tungsten vapor around said filament upon energization thereof, said energized filament being effective to cause thermal diffusion in said envelope means such that the Langmuir sheath around said filament is composed substantially totally of vaporized tungsten and said high molecular weight nonreactive gas, said helium concentration increasing outwardly from said sheath to produce a gas mixture in said enclosure means in surrounding relationship to said sheath with a thermal flux greater than that of the original gaseous mixture to cause a greater temperature gradient within said sheath that drives tungsten vapor from said sheath for redeposition on said filament.

* * * * *